United States Patent [19]

Ward, Jr.

[11] 4,295,841

[45] Oct. 20, 1981

[54] BOX BLANK FOLDING APPARATUS

[75] Inventor: Henry D. Ward, Jr., Cockeysville, Md.

[73] Assignee: The Ward Machinery Company, Cockeysville, Md.

[21] Appl. No.: 86,600

[22] Filed: Oct. 19, 1979

[51] Int. Cl.[3] ..... B31B 1/42; B31B 1/54

[52] U.S. Cl. ..... 493/295; 493/179; 493/437

[58] Field of Search ..... 93/52, 49 R, 48, 45; 53/374; 493/295, 178–182, 437, 126, 142, 151

[56] References Cited

U.S. PATENT DOCUMENTS

| | | | |
|---|---|---|---|
| 1,982,848 | 12/1934 | Wood | 93/49 R |
| 2,213,494 | 9/1940 | Gruenberg et al. | 93/52 X |
| 2,284,792 | 6/1942 | Anderson | 93/49 R |
| 3,122,069 | 2/1964 | Lopez | 93/52 |
| 3,626,660 | 12/1971 | Dorfmann | 93/52 X |
| 4,159,109 | 6/1979 | Watson et al. | 271/259 |

FOREIGN PATENT DOCUMENTS 555237 10/1974 Fed. Rep. of Germany .

*Primary Examiner*—James F. Coan
*Attorney, Agent, or Firm*—Boyce C. Dent

[57] ABSTRACT

A belt type box blank folding machine including bar folder assemblies on a downstream end thereof for engaging partially folded substantially upstanding outer panels on the blanks and folding them downward against inner panels of the blanks. The bar folders are arranged to pivot from an upright position, in engagement with the upstanding panels, to a horizontal position and to simultaneously reciprocate along the path of blank travel to provide maximum engagement with the outer panels during folding thereof. The bar folders are parallel with the fold line of the outer panels during folding thereby preventing twisting of the panels and locking of the leading flaps of the outer panels against the inner panels.

10 Claims, 15 Drawing Figures

76,84
171
168
166
154
156
158
169
167
78,86
34
62
50R
48R
60R
66
64
50C
49
68
50L
48L
60L
170
178
176
72R
74
80
150
152
162
164
160
16R
XIII

BOX BLANK FOLDING APPARATUS

BRIEF SUMMARY OF THE INVENTION

This invention is directed to apparatus for folding corrugated paperboard blanks. The apparatus generally comprises a substantially conventional belt type folder modified in accordance with this invention to permit folding of flat, continuously advancing blanks of flimsy corrugated or similar paperboard material. The apparatus includes laterally spaced endless conveyors supported for rotation on adjacent lower rails; upper folding rails spaced above the endless conveyors defining edges against which outer panels of the blanks advancing along the endless conveyors may be folded to an upright position; and flexible folding rods beginning at an infeed end of the folder alongside the lower rails and beneath the panels to be folded, such rods extending in serpentine fashion to where they are spaced above the endless conveyors so as to fold the outer panels of the blanks to an upright position. Rather than continue downward over the inner panels of the blanks, as in a conventional folder, the rods terminate at the point where the outer panels are folded upright. At this point, a bar folder assembly is pivotally and reciprocably mounted to each of the lower rails. The bar folders are arranged to engage the upstanding outer panels of the advancing blanks and fold them downward to a horizontal position above the inner panels of the blank. Adhesive previously applied to a tab on one outer panel contacts the other outer panel and adheres thereto thereby forming a folded, flat, tubular blank which is discharged from the apparatus for further handling such as stacking and bundling.

Folding of the outer panels from an upright to a horizontal position is accomplished by pivoting the bar folders downward and simultaneously reciprocating them in an upstream and downstream direction during pivoting. The apparatus is arranged to move the bar folders upstream during the first portion of downward pivotal movement; this permits the bars to rapidly engage a substantial portion of the outer panel of the blank, since the blank continues to move downstream. This provides a relatively long area of engagement with the panel so that it can be folded by parallel contact with the bar as it reverses direction and moves downstream with the blank. Such engagement prevents bending of the front edge or flap of the outer panel such as sometimes occurs when only folding rods are used as in conventional folders. Thus, flimsily constructed blanks can be folded without twisting because of the flat contact provided by the pivotable bar folders; in addition, the reciprocation of the folder bars maintain substantially continuous contact with the panels and the blanks may continue to move uninterruptedly at high speeds.

In conventional practice, one outer panel is sometimes folded downward to rest on top of the opposite panel and sometimes folded to rest beneath the opposite panel. In the preferred construction of this invention, one folding bar is ahead of the opposite folding bar in the upstream direction. Thus, the panel contacting the upstream bar will be folded first so that the subsequently folded panel will be folded on top of it. However, a third folding bar is located downstream from the first bar; when the first bar is deactivated (as will be described), the second bar folds its panel first so that the other panel is folded on top of it by the third bar.

The apparatus includes a drive shaft extending between the lower rails. The drive shaft is arranged to drive the endless conveyor belts. In addition, it is connected through a gear train and crank assembly to the folding bars to pivot and reciprocate them. A selector lever is provided to selectively operate the first and second bar folder or the second and third bar folder to cause the desired outer panel to be folded before the other.

BRIEF DESCRIPTION OF THE DRAWINGS

In the drawings wherein like parts are marked alike.

DESCRIPTION OF THE PREFERRED EMBODIMENT

Figure 1:
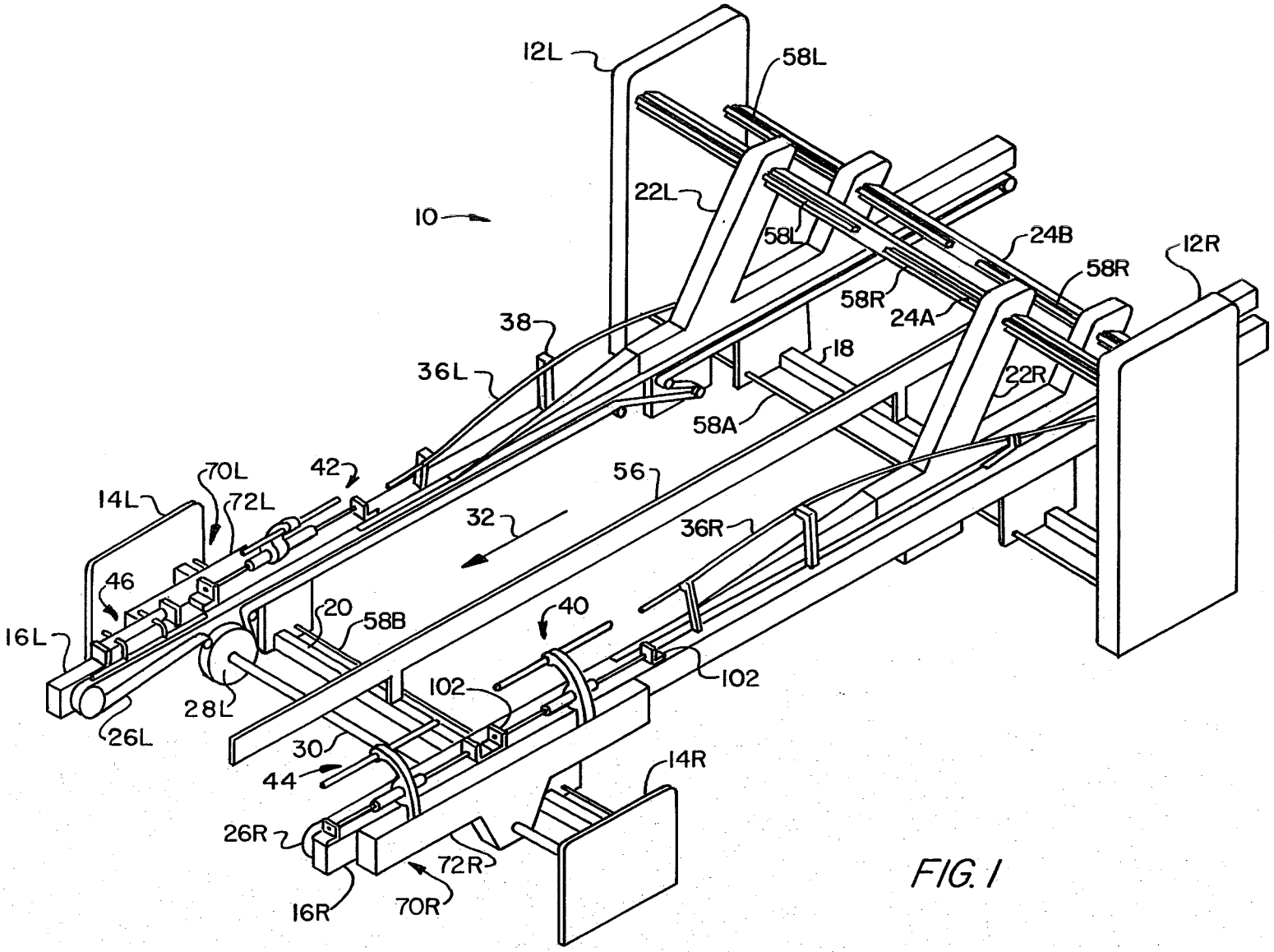
FIG. 1 is an isometric illustration of the complete folding apparatus of this invention.

Referring now to FIG. 1. the folder-gluer machine generally denoted by numeral 10 includes a pair of upstream side frames 12L and 12R and smaller downstream side frames 14L and 14R. A pair of lower folding rails 16L and 16R are supported by an upstream guideway 18 and a downstream guideway 20, both of which extend laterally between their respective side frames. A pair of upper folding rails 22L and 22R are supported on upstream guideways 24A and 24B which extend laterally between side frames 12L and 12R. A pair of endless conveyor belts 26L and 26R are mounted for rotation on the inboard side of their respective lower folding rails 16L and 16R. The belts 26L and 26R are driven by drive pulleys 28L and 28R (28R obscured from view) which are mounted for driven rotation on drive shaft 30. A jackshaft (not shown) is connected to drive shaft 30 along the left side of the folder 10. The jackshaft is customarily connected to an upstream box machine (not shown) that is immediately adjacent to the upstream end of the folder 10. The box machine is driven by a main drive motor (not shown) which also drives the folder 10 by the jackshaft arrangement just described. The conveyor belts 26L and 26R are arranged so that their upper flights travel in the downstream direction indicated by arrow 32. These belts serve to serially advance a succession of box blanks 34 (shown in FIGS. 2–5) through the folder 10 in which the outer panels of the blanks are folded as will be described.

Figure 2:
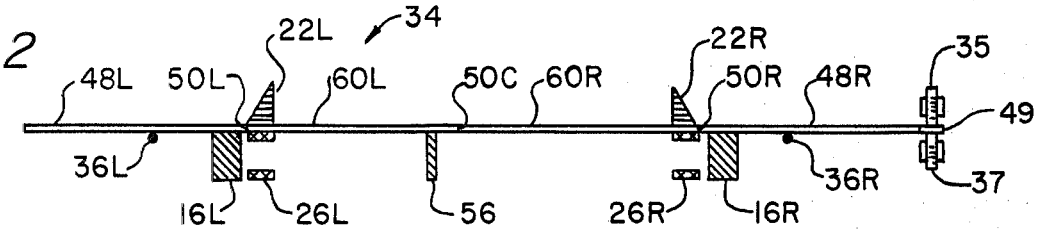
FIG. 2 is a diagrammatic illustration looking upstream toward the oncoming blanks entering the folding apparatus of FIG. 1.

A pair of flexible folding rods 36L and 36R are supported on the lower folding rails 16L and 16R by a number of supports, secured to the folding rails 16L and 16R, of which one is denoted by numeral 38, the remainder being substantially identical. The rods 36L and 36R begin alongside and outboard of the infeed end of the conveyor belts 26L and 26R as shown in FIGS. 1–2 and extend downstream in serpentine fashion, as shown in FIG. 1, to a position above the top surfaces of the respective conveyor belts 26L and 26R where they terminate as shown in FIG. 1.

A bar folder assembly generally denoted by numeral 40 is pivotally and reciprocably mounted to lower rail 16R just downstream from the terminus of folding rod 36R. A similar second bar folder assembly 42 is mounted substantially opposite to but downstream of the first folding bar assembly on the lower rail 16L just downstream from the terminus of folding rod 36L. A similar third bar folder assembly 44 is mounted to lower rail 16R just downstream from folder assembly 40 as shown in FIG. 1. A blank hold-down bar assembly 46 is mounted to lower rail 16L just downstream from the second bar folding assembly 42; the hold-down bar is adjustable as to height above the belt 26L and laterally across the width of the machine but does not pivot nor reciprocate.

The blanks 34 to be folded enter the upstream end of the folder 10 in a flat, open condition (see FIG. 2) and are advanced therethrough by belts 26L and 26R. As the blanks 34 enter the folder 10, adhesive is applied to a glue tab 49 (see FIG. 2 and FIG. 6) on the blanks (adhesive applicator obscured by side frame 12R; shown schematically in FIG. 2 by glue wheels 35 and 37). Thereafter, the blanks 34 advance downstream; as they do, the outer panels 48L and 48R are first folded to a substantially upright position (see FIG. 3) by folding rods 36L and 36R, the panels being folded along score lines 50L and 50R which have been made in the blanks 34 by the aforementioned box machine. These score lines are in substantial alignment with the lower outer edges of the upper folding rails 22L and 22R as best shown in FIG. 2. Folding of the outer panels is caused by their sliding against the folding rods 36L and 36R which are curved as shown in FIG. 1 so that the panels rise from their initial horizontal position as shown in FIG. 2 to the upright position shown in FIG. 3. The arrows 52 and 54 denote the fold angle which is preferably about 120° from horizontal; folding to this position is caused by folding rods 36L and 36R as previously described.

It should be recognized that the folding rod supports 38 are usually adjustable (detailed adjustment not shown) in the conventional manner to vary the fold angle as desired. Such adjustment is used to control folding of the outer panels 48L and 48R depending on their size, which may vary from order to order, and amount of warp as well understood by those skilled in the art. The folding rods 36L and 36R are usually flexible, being made of nylon or similar plastic material, so that they follow the position of supports 38. However, the folding rods may be rigid if desired and bent to the shape required to fold the panels or even be straight rods that are held in a skewed position relative to the direction of blank travel.

A center support 56 extends between and is mounted on guideways 18 and 20 as shown in FIG. 1 to support the center of the advancing blanks 34 to prevent them from buckling from their own weight. This support is not usually adjustable, but remains near the lateral center of the folder 10. It should also be noted here that the blanks 34 include a center score line 50C which, for the configuration of the blank depicted, moves alongside the center support 56. The center score is always in the lateral center of this type machine; therefore, placing the center support 56 slightly off center prevents the score 50C from riding on it to prevent skewing.

The lower folding rails 16L and 16R, which also support the folding rods 36L and 36R and conveyor belts 26L and 26R, are adjustable toward and away from the lateral center of folder 10 to position them for alignment with the score lines 50L and 50R in the blanks being folded, it being understood that the aforementioned box machine is capable of processing blanks of different sizes. The upper folding rails 22L and 22R are likewise adjustable for the same reason. Adjustment of the lower rails is achieved by the use of motorized screw shafts 58A and 58B passing through conventional ball nuts (not shown) in the supports for such members. The screw shafts 50A and B are similar but may vary with respect to length, location, and the side of the folder 10 from which they are driven. In addition, it is not believed necessary to identify the individual supports for the various rails since their location and function are readily apparent from FIG. 1 to those skilled in the art. If desired, conventional spur tooth racks mounted on the cross members 18 and 20 may be used to position the lower rails instead of the screw shafts 58A and 58B. If so, the rails 16L and 16R will include spur tooth pinions (not shown) in driven engagement with the racks.

Spur tooth racks 58L and 58R may be mounted to the supports 24A and 24B, similar to that just described, for lateral positioning of the upper rails 22L and 22R. The upper rails include spur tooth pinions (not shown) in driven engagement with the racks to move the rails as will be readily understood by those skilled in the art. The racks 58L and 58R terminate near the center of the supports 24A and 24B; individual spur tooth drives as mentioned above permit the rails to be adjusted individually for proper positioning to obtain the best folding of the blanks.

Figure 3:
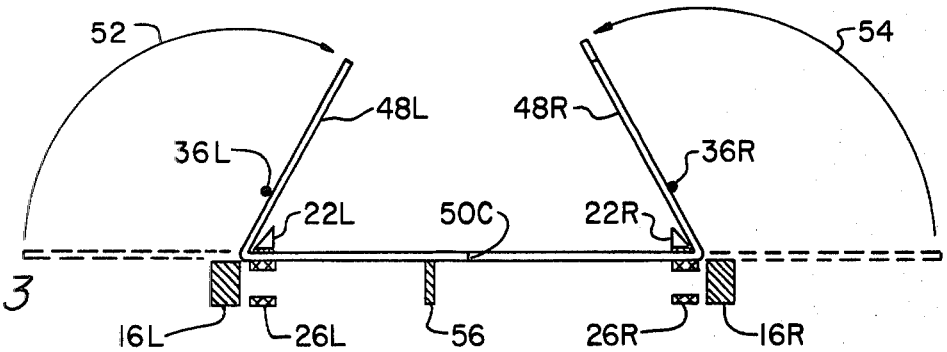
FIG. 3 is a diagram similar to FIG. 2 showing the position of the outer panels of the blank at the end of the folding rods.

After the blanks 34 reach the position shown in FIG. 3 with the outer panels 48L and 48R in a substantially upright position, they advance between the bar folder assemblies 40 and 42 shown in FIG. 1. At this point, it should be understood that one of the outer panels 48L and 48R must be folded downward ahead of the other against the inner panels 60L and 60R because the glue tab 49 must be either on the top of or beneath the panel 48L to glue the tab to the panel. When the tab 49 rests on top of panel 48L, an outside glue joint is formed; when it rests beneath the panel, an inside glue joint is formed. The glue wheels 35 and 37 may be reversed to apply adhesive to either the top or bottom of tab 49 to provide either an inside or outside glue joint. Thus, if an inside glue joint is to be formed, outer panel 48R is folded first by pivoting of bar folding assembly 40 (FIG. 1) and then outer panel 48L is folded over it by pivoting of bar folder assembly 42 (FIG. 1). In this instance, after folding, the folded panel 48L is held against the inner panel 60L and on top of the glue tab 49 by the hold-down bar assembly 46 (FIG. 1) as the blank 34 advances out of the machine. The bar folder assembly 44 is not pivoted in this sequence since outer panel 48R has been folded by bar folder assembly 40.

Conversely, if an outside glue joint is to be formed, outer panel 48L is folded first by pivoting of bar folder assembly 42 and then outer panel 48R is folded over it by pivoting of bar folder assembly 44. In this instance, the hold-down bar assembly 46 need not be used since the last folded panel 48R is held down by bar folder assembly 44 as the blank 34 advances out of the machine. The bar folder assembly 40 is not pivoted in this sequence since outer panel 48R is folded last by bar folder assembly 44. The alternate operation of bar folder assemblies 40 and 44 will be subsequently explained.

It should be understood that the blanks 34 are fed through the box machine (not shown) at fixed timed intervals; since the folder 10 is driven by the box machine, the blanks travel through it at the same intervals. Thus, once the bar folders 40, 42, and 44 are adjusted, by disengaging a clutch as will be explained, to begin pivoting downward to fold the outer panels 48L and 48R as they reach the selected one of the bar folders 40 or 42, no further adjustments are required. That is, the bar folders 40 or 42 will begin pivoting at the same timed intervals that the blanks reach them.

Figure 4:
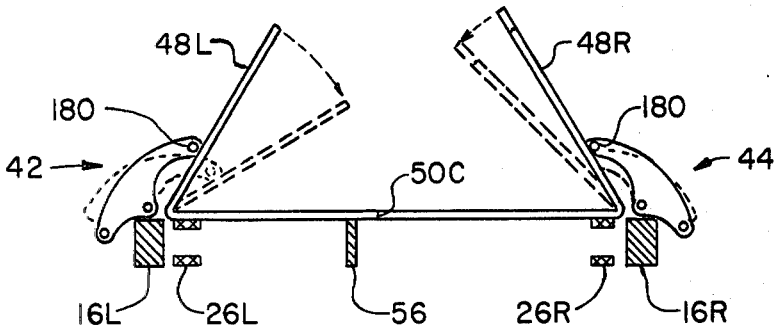
FIG. 4 is a diagram similar to FIG. 3 showing the position of the outer panels of the blank at the beginning and partly through the fold made by the pivotable bar folder.
Figure 5:
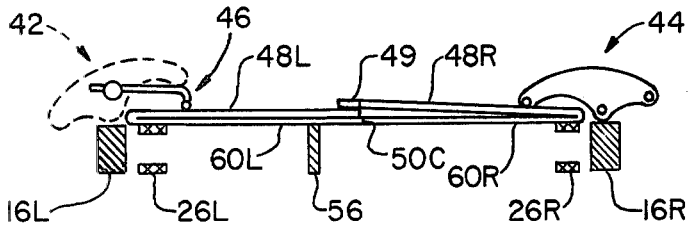
FIG. 5 is a diagram similar to FIG. 4 showing the position of the outer panels and the pivotable bar folder after the outer panels have been completely folded.
Figures 6, 11, 13:
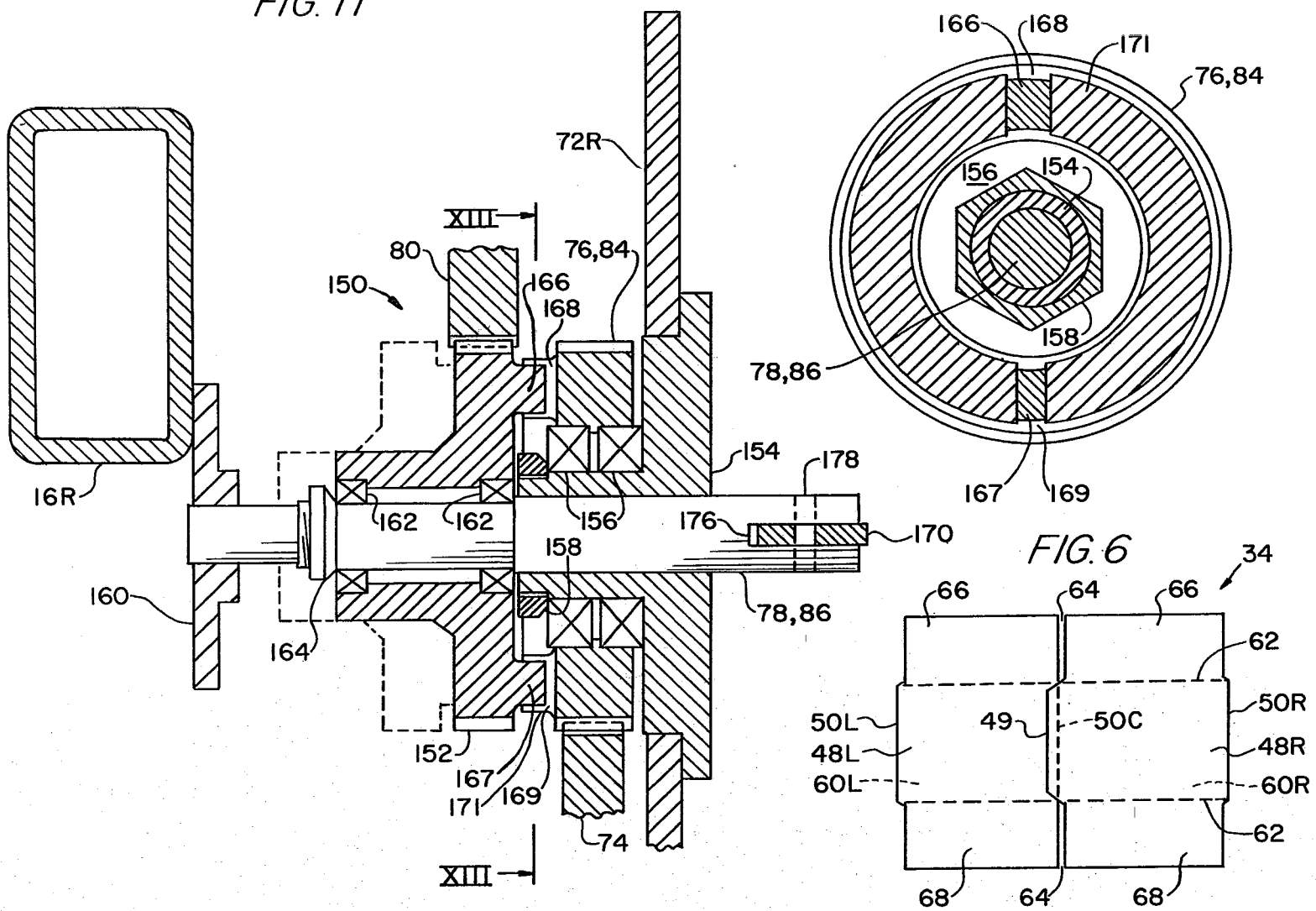
FIG. 6 is a top view of a blank in its completely folded position after being folded by the apparatus of FIG. 1.
FIG. 11 is a detailed view of the clutch mechanism for the bar folders taken along line XI—XI of FIG. 7.
FIG. 13 is a section view of a portion of the clutch mechanism of FIG. 11 taken along the line XIII—XIII.

Referring now to FIG. 4, the blank 34 is shown being advanced beneath bar folder assemblies 42 and 44 with the outer panel 48L being folded first to form an outside glue lap. Because bar folder assembly 42 is upstream, although on the opposite side from bar folder assembly 44, the outer panel 48L is folded to the dotted line position by pivoting of assembly 42 and panel 48R is folded to the dotted line position by assembly 44. Pivoting of assemblies 42 and 44 continues until the panels 48L and 48R are completely folded over the inner panels 60L and 60R as shown in FIG. 5. The blank 34 advances out of the machine in this flat tubular configuration as illustrated in FIG. 6. The blank 34 also includes transverse score lines 62 and 64 thereby creating top and bottom flaps 66 and 68 which, when the folded and glued blank is opened, form the top and bottom of a complete box as is well understood by those skilled in the art.

Figure 7:
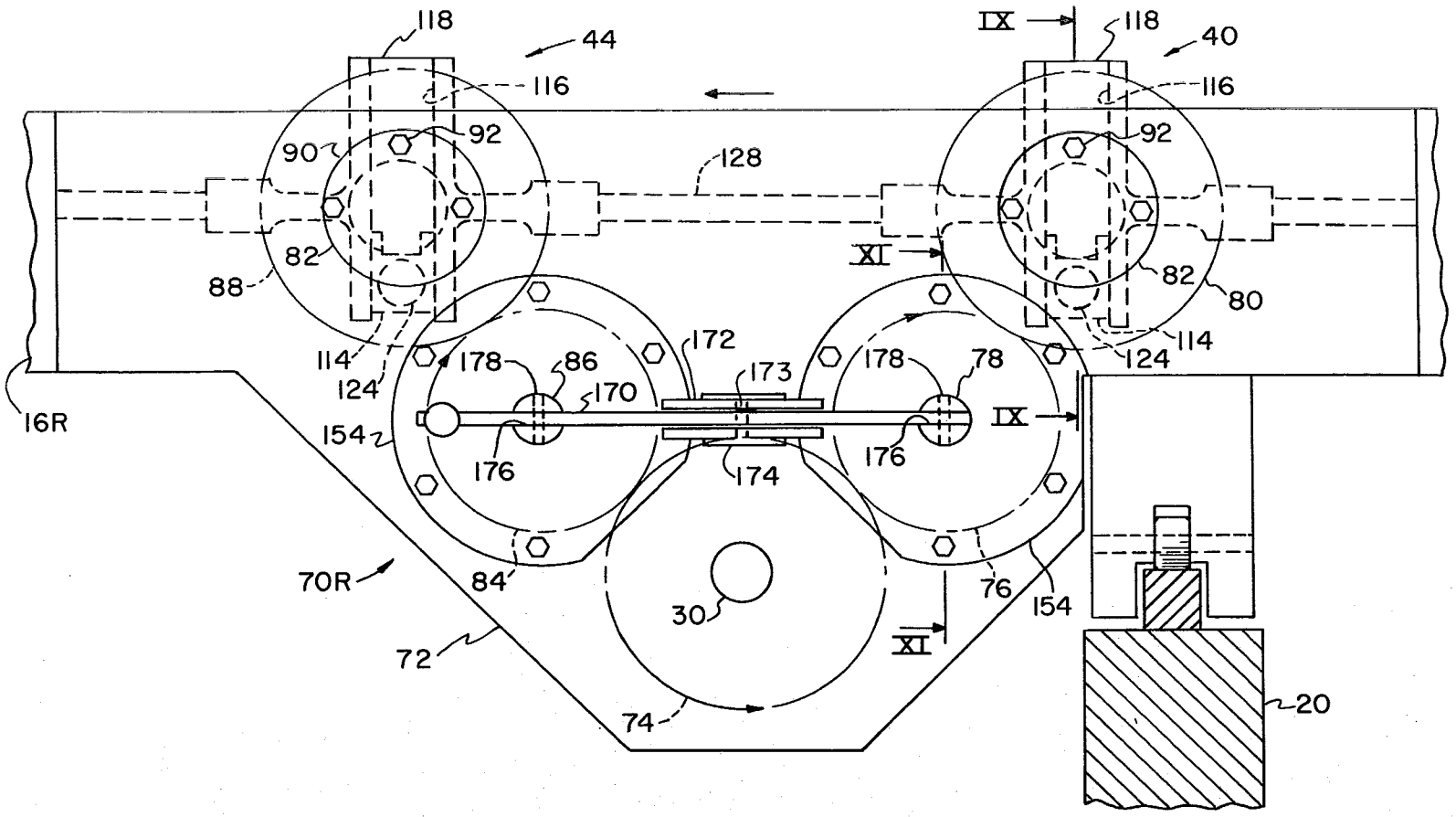
FIG. 7 is a side elevation view partially illustrating the gear and crank arrangement used to pivot and reciprocate the bar folders from the drive shaft.

The apparatus provided for pivoting and reciprocating the bar folder assemblies 40, 42, and 44 is illustrated in FIGS. 7–11. The drive shaft 30 shown in FIG. 1 passes through a main gear and crank arrangement, generally denoted by numeral 70L on the left side of FIG. 1 and 70R on the right side, which are supported on the lower rails 16L and 16R respectively by support enclosures 72L and 72R. Referring to FIG. 7, a conventional spur tooth gear 74 is secured for rotation on drive shaft 30 inside enclosure 72R. A similar gear 76 is supported for rotation about a stub shaft 78 and is driven engagement with gear 74. Another gear 80 is supported for rotation about a stub shaft 82 and in driven engagement with gear 76. The gears rotate in the direction indicated by the arrows on the pitch circle of the gears. This set of gears 74, 76, and 80 is used to pivot and reciprocate bar folder assembly 40 as will be subsequently explained in connection with FIGS. 8 and 9. A similar set of gears and associated apparatus are supported in enclosure 72L for pivoting and reciprocating bar folder assembly 42; since the parts are identical, they are not shown and the description of the above arrangement will suffice for the gear arrangement for bar folder assembly 42.

Still referring to FIG. 7, a similar set of gears is used to pivot and reciprocate bar folder assembly 44. More specifically, a gear 84 is supported for rotation about a stub shaft 86 and in driven engagement with gear 74 on drive shaft 30. Another gear 88 is supported for rotation about a stub shaft 90 and in driven engagement with gear 84. These gears rotate in the direction indicated by the arrows and are used to pivot and reciprocate bar folder assembly 44.

Figure 9:
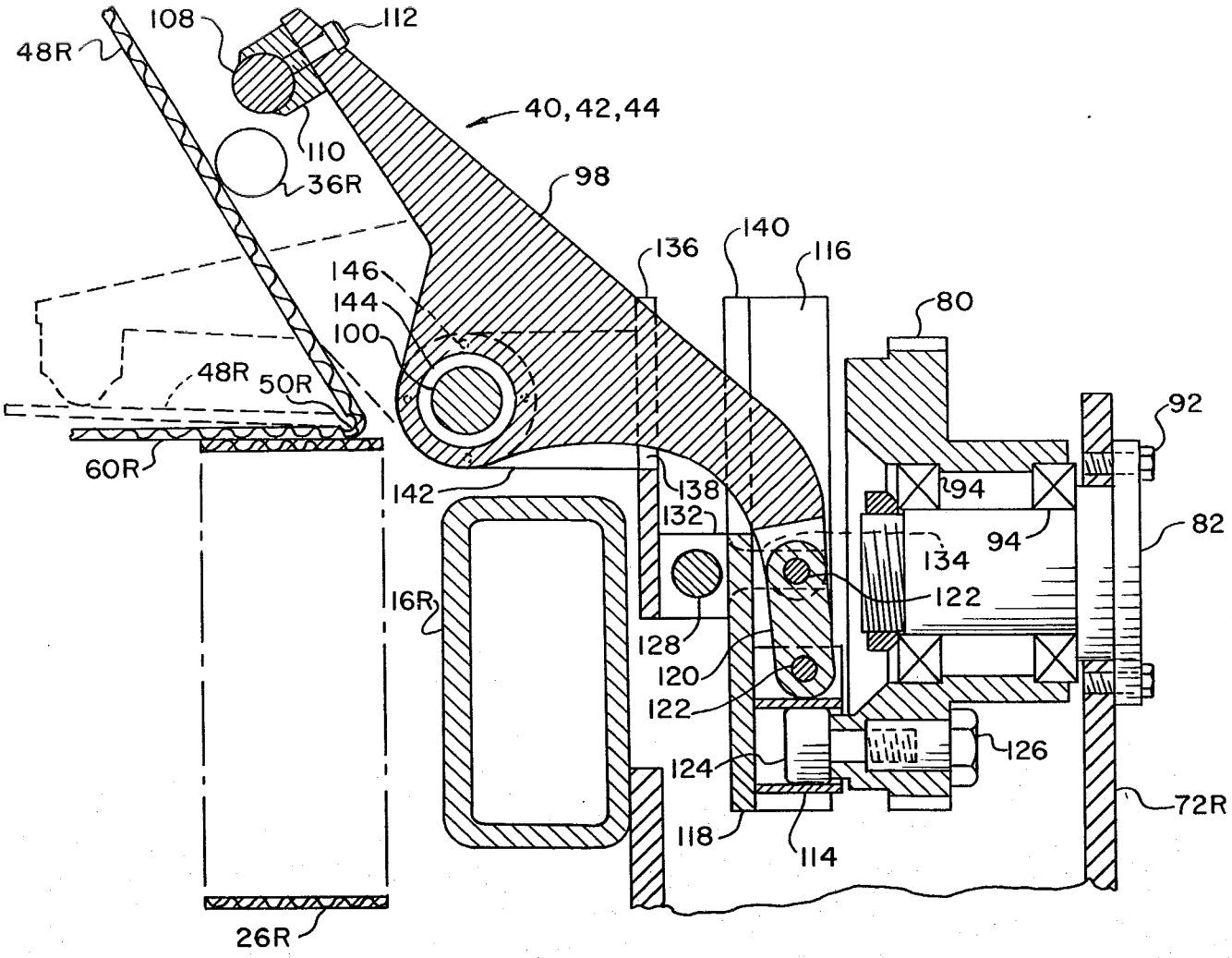
FIG. 9 is a detailed view of the pivot mechanism for the bar folders taken along line IX—IX of FIG. 7.

Referring now to FIG. 9, stub shaft 82 is mounted to the outer wall of enclosure 72R by screws 92 as shown. Gear 80 is supported for rotation about stub shaft 82 by conventional bearings 94. The gear 80 is retained on shaft 82 by a nut 96 threaded on the shaft against one bearing 94.

Only one of the bar folder assemblies 40, 42, and 44 will be described since they are all similar. Still referring to FIG. 9, bar folder assembly 40 includes a pivot arm 98 pivotable about a pivot shaft 100. Pivot shaft 100 is supported on top of lower rail 16R by shaft supports 102 (shown on FIG. 1). The pivot arm 98 preferably includes additional spaced arm segments 104 connected by tubular portions 106 surrounding pivot shaft 100 as shown on FIG. 10 which is a top view of a portion of the assembly. A folding rod 108 is secured to pivot arm 98 and segments 104 by short blocks 110 held in place by screws 112 as shown on FIG. 9. Thus, a pivot arm 98 is pivoted, the rod 108 moves from the upright position shown in solid lines on FIG. 9 to the dotted line position thereby folding the outer panel 48R to the dotted line position.

Pivoting of pivot arm 98 is accomplished by connecting it to a crank slide 114 which moves up and down in a groove 116 in a slide block 118. Pivot arm 98 is connected to crank slide 114 by a link 120 which is itself connected by pins 122 to both the arm 98 and crank slide 114. The link 120 permits the adjacent end of arm 98 to move in an arc as it is pivoted up and down.

The crank slide 114 is caused to move up and down by a bearing 124 which is secured to a stud 126 passing through the gear 80 as shown on FIG. 9. It can be seen that as gear 80 rotates, the bearing 124 will revolve about the central axis of the gear thereby causing the crank slide 114 to move up and down in the groove 116 and, as it does, pivot the pivot arm 98. A front view of this arrangement appears diagrammatically on FIG. 7.

It can also be seen, referring to FIG. 9, that as the gear 80 rotates, carrying the bearing 124 with it, the slide block 118 must move in a horizontal direction; otherwise, the assembly would bind up. This necessary motion is used to reciprocate the bar folder assembly 40. This is achieved by mounting the slide block 118 on a slide rod 128. Slide rod 128 is secured to the side face of lower rail 16R by a center support block 130 with the ends of slide rod 128 supported in the ends of enclosure 72R as shown on FIG. 8. Thus, as the gear 80 rotates, the revolving movement of bearing 124 causes the crank slide 114 to move up and down, as previously described, and also causes the slide block 118 to move horizontally along slide rod 128 thereby creating a compound motion of pivoting and reciprocation of the bar folder assembly 40.

Figure 8:
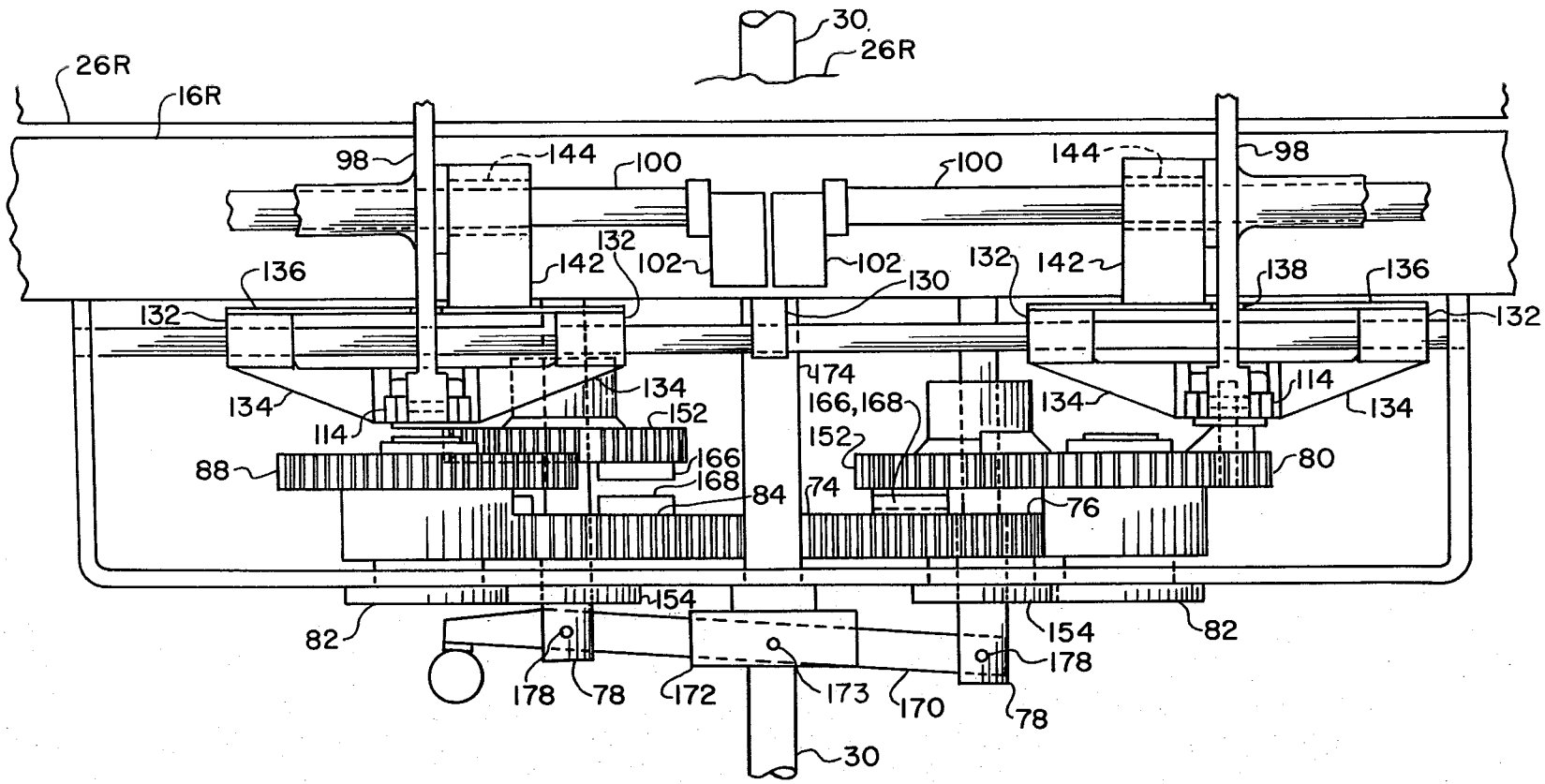
FIG. 8 is a top view of the apparatus of FIG. 7.

Referring to FIGS. 8 and 9, the crank slide 118 is connected for sliding engagement along rod 128 by two blocks 132 spaced from the crank slide groove 116 by webs 134. The blocks 132 stabilize the slide block 118 and prevent it from binding as it reciprocates along the rod 128. A plate 136 spans the distance between blocks 132 and is connected thereto in any convenient manner. Plate 136 includes a notch 138 through which pivot arm 98 passes. Slide block 118 includes a similar notch 140 for the same purpose. A rod support 142 is mounted to plate 136 and extends over lower rail 16R (as shown in FIG. 9) and surrounds rod 100. A bushing 144 is secured to pivot arm 98 such as by screws 146 and is also retained within rod support 142. Thus, as slide block 140 is caused to reciprocate along rod 128 as previously explained, it reciprocates pivot arm 98 along rod 100 via the connection provided by the plate 136, rod support 142, and bushing 146. At the same time, the pivot arm 98 pivots about rod 100 via its connection to bushing 144 which slides along the rod and pivots about it.

Figure 12:
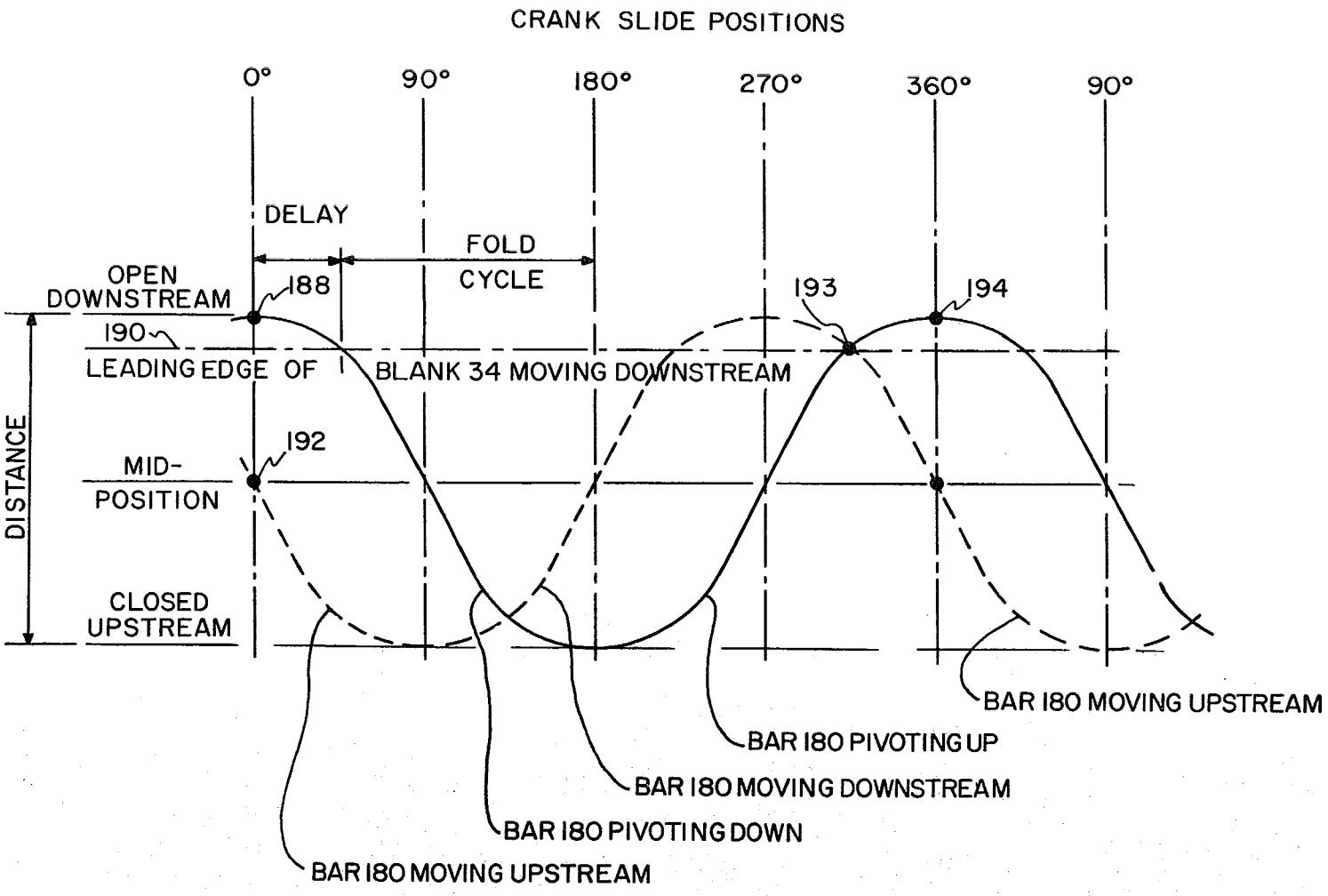
FIG. 12 is a sine wave diagram illustrating the pivotal position of the bar folders relative to their reciprocable position.

FIG. 12 is a diagram illustrating the simultaneous reciprocation of and pivoting of bar folder assemblies 40, 42, and 44 as blanks 34 advance beneath them. This diagram corresponds to the position of the crank slide 114 shown in FIG. 7 where, with the crank slide in the down position, the rod 108 of the folding assembly 40 (for example) is fully up at the beginning of the cycle denoted 0°. It should be understood that the flexible rod 36R (FIG. 3) folds the outer panel 48R through the fold angle 54 a distance sufficient to permit the leading edge of the blank 34 to pass beneath the folding rod 108 without interference when the folding bar assembly 40 is pivoted fully up and the rod 108 is in its midposition during its upstream reciprocation. The clearance between folding rod 108 and outer panels 48L and 48R is shown in FIG. 4; this same clearance is diagrammatically illustrated in FIG. 12 where the full up position of the bar folder assembly is denoted by the point 188 when the crank slide 114 is at the 0° position. At that point, the phantom line 190 illustrates that the leading edge of the blank 34 clears the folding rod 108 as the leading edge of the blank crosses the 0° position of the folding assembly 40; this clearance is indicated as a "delay" before the rod 108 engages the panel 48R. It can be seen that the folding rod 108 is in the midposition of its upstream stroke at the 0° position of the crank slide 114 as denoted by the point 192. The crank mechanism illustrated in FIG. 7 (gear 80, crank 118, crank slide 114) imparts sinusoidal motion to the bar folder assembly 40 as previously explained (also bar folder 42 and 44). Thus, it can be seen, by following the sine wave velocity curve for the pivoting action of bar folder 40, that the rod 108 is in the full up position when the crank slide is at 0°, at the bottom of crank 118 as shown in FIG. 7. Thereafter, the rod 108 will be fully down to fold the outer panel 48R when the crank slide 114 reaches 180° of a full revolution; the rod 108 will begin to rise as the crank slide returns to the 0° position after 360° of rotation of gear 80 as denoted by the point 194 at the intersection of the sine wave curve and the 360° line. It can also be seen the rod 108 is in the midposition of its upstream stroke, as denoted by point 192, when it begins pivoting downward at the 0° beginning of rotation of the crank 118. Rod 108 continues moving upstream until the crank 118 reaches 90° of its full rotation. Meanwhile, it can be seen that during this first 90° of rotation, the leading edge of blank 34 has passed beneath the rod 108 while the rod is still moving upstream; the blank continues to move downstream thereby resulting in more engagement of the rod 108 with the panel 48R than if the rod moved downstream or was stationary at the time it first engaged the panel. As can be seen by following the dashed sine wave curve, the rod 108 begins moving downstream at the 90° point of rotation of crank 118, just as it arrives at the midpoint of its pivotal downward movement, and moves in the same direction as the blank 34 while continuing to fold the panel 48R downward against inner panel 60R. However, the rod 108 begins pivoting upwardly at 180° while it is still moving downstream but begins moving upstream before it has pivoted to its full upward position at 360° of full rotation of crank 118 as illustrated by the sine wave curves. From the foregoing, it can be seen that the cycle of reciprocable movement lags the pivoting cycle by 90° resulting in maximum engagement of the bar 108 with the outer panel 48R during folding. The bar folder assembly 42 operates in the same manner when it is selected to fold the outer panel 48L first. Bar folder assembly 44 operates in a like manner, being spaced downstream the proper distance to engage the outer panel 48R in the same manner as it is engaged by bar folder assembly 40 when the latter has been selected to fold outer panel 48R first.

Preferably, the gear 80 (and corresponding gears for bar folders 42 and 44) is timed with drive gear 74 so that the leading edge of the blank 34 just clears the end of rod 108 as it passes beneath it; thus, the blank will begin passing beneath the rod beginning at point 193 on FIG. 12 to permit the maximum amount of the outer panel to be engaged by the rod 108.

One revolution of the crank 118 corresponds to the spacing between the leading edge of one blank to the leading edge of the blank following along the length of the belts 26L and 26R. This spacing results from the fact that the blanks are fed at timed intervals into the box machine in the well known manner. Thus, it can be seen that when blanks, shorter than the maximum length which can be fed into the box machine, are fed into the box machine, the spacing between the leading edges remains the same although there will be a gap between the trailing edge of one blank and the leading edge of the next. Since the bar folders 40, 42, and 44 are timed to the leading edges of the blanks, folding will occur at the proper time regardless of the length of the blanks.

As previously mentioned, one of the bar folder assemblies 40 and 42 is selected to make the first fold. When bar folder 40 is selected, bar folder 44 is inoperative; when bar folder 42 makes the first fold, bar folder 40 is inoperative. In either case, bar folder 42 remains operative, making either the first or second fold.

Selection of either bar folder 40 or 44 for operation is accomplished by connecting gear 76 or 84 to gears 80 or 88 (See FIG. 7) by means of a selectively operable clutch assembly 150 as shown in FIG. 11. By way of example, and as previously mentioned, gear 74 is connected to gear 80 through gear 76. Gear 76 comprises one-half of clutch assembly 150; a gear 152 (FIG. 11) comprises the other half and is actually the gear that drives gear 80. Gear 76 (as is gear 84) is mounted for rotation about a housing 154 by bearings 156. The bearings 156 are secured to housing 154 by a threaded nut 158 on the end of housing 154 in the well known manner; this, in turn, retains gear 76 on the housing. Housing 154 is secured in a convenient manner to enclosure 72R. A stub shaft 78 passes through housing 154 and has its opposite end supported by a housing 160 secured to lower rail 16R. Gear 152 is supported for rotation about stub shaft 78 by bearings 162 and is held on the shaft by a threaded nut 164 in the well known manner.

Gear 152 includes a pair of diametrically opposed lugs 166 and 167 on the side face facing gear 76. These lugs seat in matching recesses 168 and 169 formed in a protruding ring 171 on the adjacent face of gear 76. These lugs form a single position clutch which will only engage in one place around the circumference of gear 76. This is accomplished by making recess 168 larger than recess 169; the matching lugs 166 and 167 are made to fit in the corresponding recesses as shown in FIG. 13. This preserves the timing of gear 152 with respect to gear 76 and consequently the timing of the folding bar with respect to the drive train of the folder. While these lugs are in mesh, gear 76 drives gear 152 but when the lugs are moved out of engagement, the gear 76 will rotate but will not drive gear 152. Gear 152 is moved out of engagement (as will be subsequently explained) with gear 80 to the dotted line position shown in FIG. 11; at the same time, the lugs 166 and 168 are pulled out of engagement thereby preventing rotation of gear 80, and consequently rotation of the slide block 118 to disable the bar folder assembly 40.

FIGS. 7 and 8 illustrate the manner in which the bar folder assemblies 40 and 44 are selectively operated. Referring to FIG. 8, a selector lever 170 is pivotally mounted by a pin 173 in a yoke 172 secured to a stub shaft 174. Stub shaft 174 passes through enclosure 72R and is anchored in a convenient manner to lower rail 16R (connection not shown). Lever 170 is also pinned in a groove 176, by pins 178, in the ends of stub shafts 78. The arrangement is such that when the lever 170 is pushed in on the left, as viewed in FIG. 8, the stub shaft 78, upon which gear 152 is mounted (See FIG. 11), moves in toward lower rail 16R, thus moving gear 152 our of mesh with gear 84 and simultaneously moving the other gear 152 into mesh with gear 80; this, of course, disables the bar folder assembly 44. Conversely, when lever 170 is pushed in on the right side, gear 152 is moved out of engagement with gear 76 and bar folder assembly 40 is disabled. In this manner, bar folder assemblies 40 and 44 are selectively operable.

Figure 10:
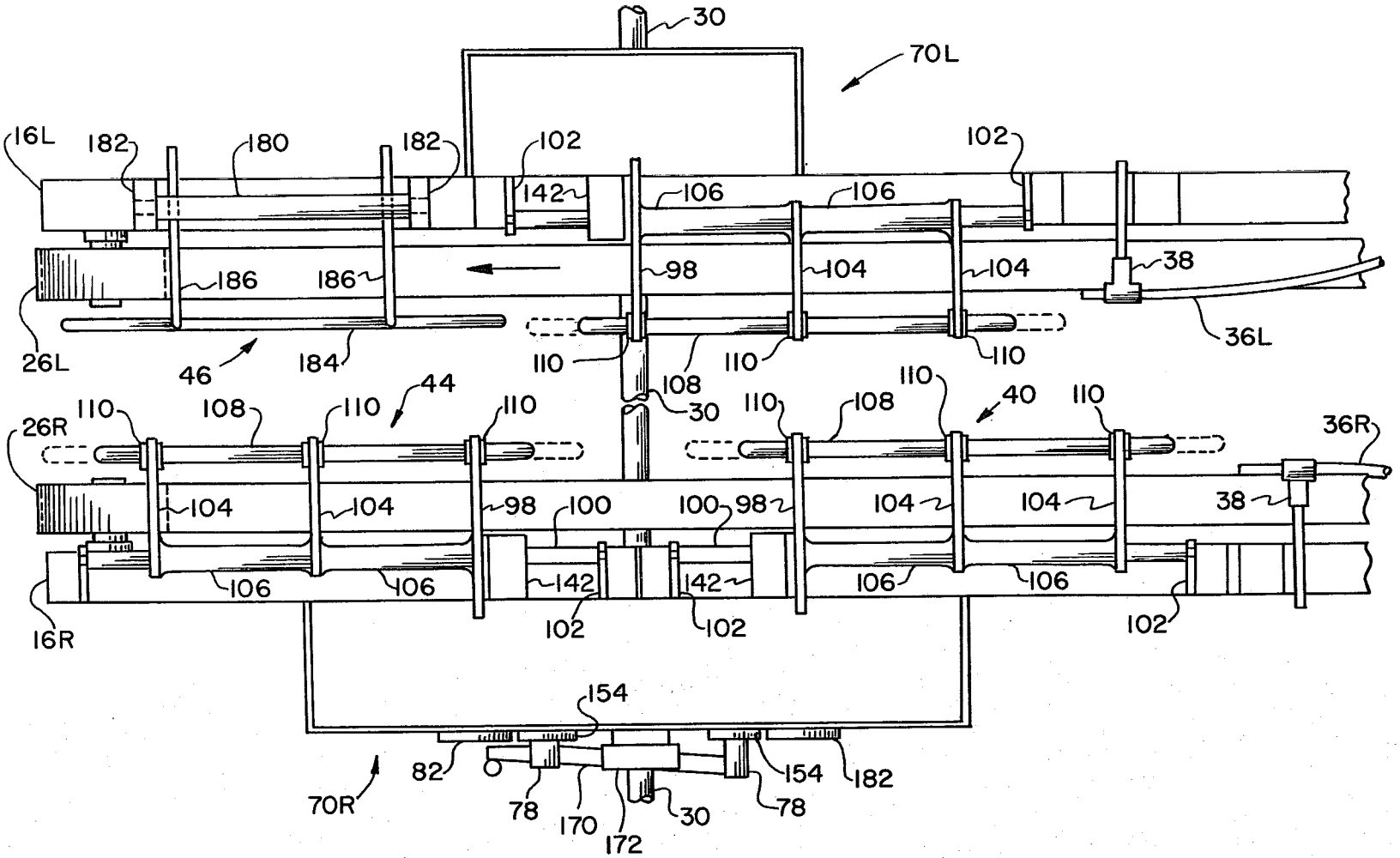
FIG. 10 is a top view of the bar folders showing their location on both sides of the folding apparatus.

The holddown bar assembly 46 includes a support bar 180 clamped (clamps not shown) between a pair of brackets 182 secured to lower rail 16L as best illustrated in FIG. 10. The holddown rod 184 itself is secured to a pair of support rods 186 which pass through the support bar 180. The support rods 186 are preferably clamped (clamps not shown) in the support bar 180 so that the holddown rod 184 can be moved laterally a small amount to lie over the folded panel 48L wherever desired. In addition, the support bar 180 is preferably pivotable in the brackets 182 so that the rod 184 may be raised or lowered to exert greater or lesser pressure against the folded panel 48L as will be well understood by those skilled in the art.

The operation of the various elements of folder 10 has been described in connection with the description of the individual elements. Accordingly, no further description of operation of such elements is believed necessary.

So far as overall operation is concerned, to fold the blanks 34 in the manner described, it is only necessary to position the flexible folding rods 36L and 36R to fold the outer panels 48L and 48R to a substantially upright position as previously described. Such settings depend somewhat on the proportions of the blanks being folded and are well understood by those skilled in the art. In addition, it must be determined which of the outer panels is to be folded first and the appropriate bar folder assembly 40 or 44 disabled as hereinbefore set forth. Thereafter, blanks 34 may be fed from the box machine (not shown) into the folder machine 10 where the outer panels 48L and 48R will be partially folded at first by the rods 36L and 36R and then finally folded by the folding bar assemblies 40 and 42 or 42 and 44, depending on which outer panel is to be folded first. After folding, the blanks 36 are advanced out of the folder 10 for further processing.

As previously mentioned, several bar folder assemblies can be used in place of the flexible folding rods 36L and 36R. Such an arrangement is shown diagrammatically in FIG. 14. In this arrangement, the bar folder assemblies 40, 42, and 44 and the hold-down bar assembly 46 remain as previously described. A number of additional bar folder assemblies 188, 190, 192, and 194 are mounted upstream from the aforementioned assemblies as shown. These latter assemblies are essentially the same as the former in construction as will be described in connection with FIG. 15. The main difference is that the bar folders 188 and 190 are arranged so that the rod portions 204 (denoted by the same numeral on all the additional assemblies) that contact the outer panels 48L and 48R begin by underlying the panels as the blank 34 enters the folder 10 in a flat, unfolded condition; the bar folders 188 and 190 are arranged to pivot upward to result in a fold angle of about 60°. These assemblies reciprocate in the direction of blank travel as previously described. In addition, they pivot simultaneously since, at this point, it is not necessary to fold one panel ahead of the other.

The next pair of bar folders 192 and 194 continue folding the panels upwardly from about 60° to about 120°, the same as the panels were folded by the flexible rods 36L and 36R. The principal advantage is that the bars 204 are parallel to the panels 48L and 48R during folding so that the panels are not twisted as they are folded.

The assemblies 188, 190, 192, and 194 are driven by a cross shaft 208. Cross shaft 208 extends between side frames 12L and 12R and passes through gear and crank assemblies (not shown) similar to assemblies 70L and 70R, which were previously described, and drive the associated bar folder assemblies in essentially the same manner. However, it should be understood that the clutch assembly shown in FIGS. 11 and 13 is not needed since the additional bar folder assemblies remain operative at all times. Cross shaft 208 may be driven by being connected to the aforementioned jackshaft (not shown).

Figure 14:
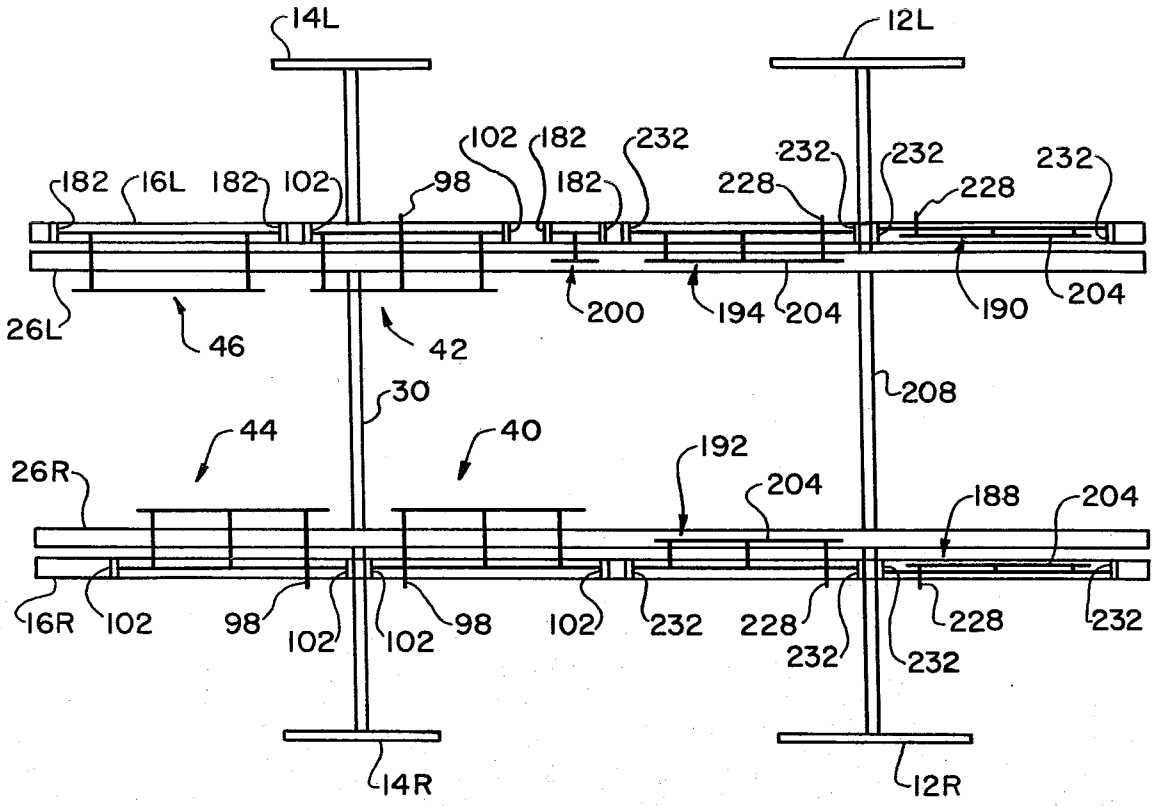
FIG. 14 is a diagrammatic top view of the folding machine illustrating the use of bar folding assemblies rather than flexible folding rods on the upstream end of the machine.
Figure 15:
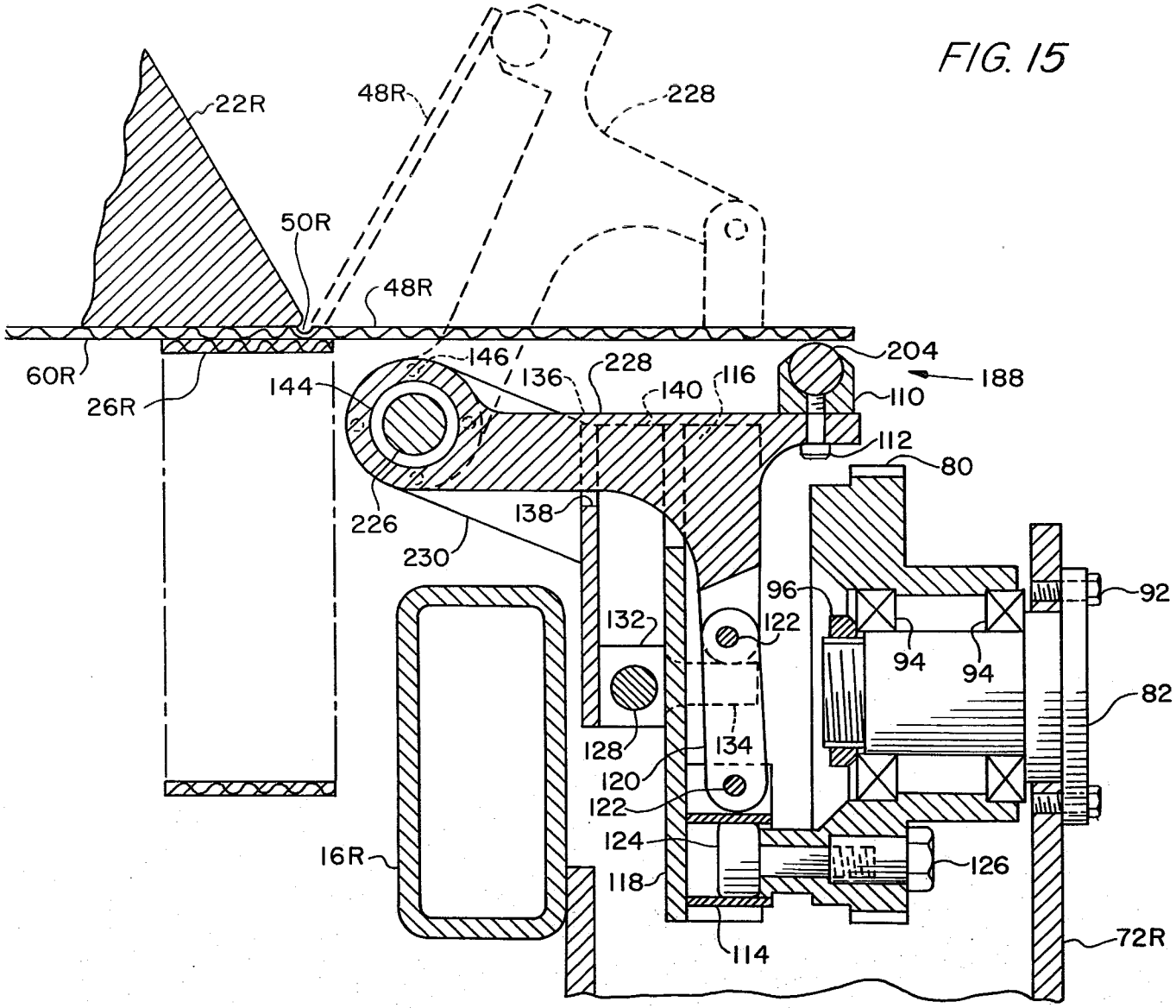
FIG. 15 is a detailed view of the pivot mechanism for the bar folders of FIG. 14 taken along line XV—XV of FIG. 14.

As shown in FIG. 14, it can be seen that bar folding assemblies 188, 190, 192, and 194 are evenly spaced on either side of cross shaft 208. This permits them to be connected to their associated crank slide 114 by pivot arms 228 (FIG. 15) using the same gearing arrangement as decribed for bar folder assemblies 40, 42, and 44. But, since bar folder assembly 194 is farther away from bar folder assembly 42, because bar folder assembly 42 is downstream from bar folder assembly 40 for the reasons previously described, there is a gap between bar folder assembly 194 and bar folder assembly 42. The outer panel 48L of the blank 34 must be held in its 120° fold angle position as it passes through this gap so that it will enter under rod 108 of bar folder assembly 42. It is not desirable to extend the length of rod 204 on bar folder assembly 194 to span the gap since the bar folder assembly 194 will begin pivoting upward before the panel 48L clears the rod 204; this will permit the panel 48L to spring upward so that it will not enter beneath rod 108 as it should.

Accordingly, the gap between bar folder assemblies 194 and 42 is filled with a hold-down bar assembly 200 similar in all respects to hold-down bar assembly 46 except that it is shorter as shown. Thus, it may be pivoted upward to a fold angle of about 120° corresponding to the fold angle of bar folder assembly 194. In this manner, the outer panel 48L is held at the proper fold angle to enter beneath the rod 108 of bar folder assembly 42.

It can be seen that the bars 204 on bar folder assemblies 188 and 190 are not in longitudinal alignment with bars 204 on assemblies 192 and 194 and are not in longitudinal alignment with the bars 108 on the bar folder assemblies 40, 42, and 44 as viewed in FIG. 14 which is a top view of the folder 10. This may be more readily understood by referring to FIG. 15. Since the bar folder assemblies 188 and 190 at the entrance end of folder 10 must be arranged so that the bars 204 underlie the panels 48L and 48R, it is necessary to mount the support bar 226 (equivalent to bar 100, FIG. 9) over the rail 16R but beneath the outer panel 48R so as not to interfere with advancement of the blank 34. This also requires that the rail 16R be lower relative to the height of conveyor 26R as shown. It can also be seen that the shape of the pivot arm 228 must be different from the pivot arm 98 shown in FIG. 9. The support 230 for the pivot arm 228 must also be shaped differently and link 120 must be longer to make the arm 228 pivot the desired distance. Otherwise, the assemblage of the parts is substantially the same as shown in FIG. 9 and the same part numbers are used in FIG. 15. Since the folding rods 204 rise to different heights (e.g. 60° and 90°) because the folds are made in steps, it can be seen why the rods 204 are not in longitudinal alignment as shown in FIG. 14.

Depending on the spacing between blanks, it may be necessary to include a hold-down bar assembly, similar to hold-down bar assembly 200, between bar folder assemblies 188 and 192, between bar folder assemblies 192 and 40, and between bar folder assemblies 190 and 194 so that the advancing blanks 34 are held at the fold angle provided by the next upstream bar folder assembly for a time sufficient to permit the next downstream bar folder assembly to rise to its position for receiving the blank. It can also be seen that the length of the folder 10 would have to be increased to accommodate additional hold-down bar assemblies 200.

Thus, the invention having been described in its best embodiment and mode of operation, that which is desired to be claimed by Letters Patent is:

1. Box blank folding apparatus comprising in combination:

advancing means for serially advancing box blanks continuously through said apparatus;

first folding means near an upstream end of said advancing means for folding outer panels of said box blanks to a substantially upright position as said blanks advance through said apparatus, said first folding means comprising pivotable bar folder means near an upstream end of said advancing means and reciprocable in the direction of travel of said blanks for engaging substantial portions of said outer panels during the advance of said blanks through said apparatus; and second folding means downstream from said first folding means for folding said outer panels from said upright position to a substantially horizontal position against inner panels of said blanks, said second folding means comprising pivotable bar folder means reciprocable in the direction of travel of said blanks for engaging substantial portions of said outer panels during the advance of said box blanks through said apparatus.

2. Box blank folding apparatus comprising in combination:

first and second laterally spaced endless conveyor means for serially advancing box blanks continuously through said apparatus;

first and second upper rail means spaced above each of said conveyor means respectively and defining edges against which outer panels of said blanks may be folded to a substantially upright position;

first and second folding means underlying said outer panels near an upstream end of each of said conveyor means respectively and extending to a position overlying a top surface of said conveyor means for folding said outer panels from a horizontal position to said upright position as said blanks advance along said conveyor means;

a first bar folder means above said first conveyor means and downstream from said first folding means; and a second bar folder means above said second conveyor means and downstream from said second folding means, both of said bar folder means operable for folding said outer panels from said upright position to a substantially horizontal position over inner panels of said box blanks, said bar folding means being pivotable from a substantially upright position adjacent said upright outer panels to a substantially horizontal position and being longitudinally reciprocable in an upstream direction during a first portion of pivotable movement of said bar folder means in a downward direction from said substantially upright position to said substantially horizontal position and being longitudinally reciprocable in a downstream direction during the remaining portion of pivotable movement of said bar folder means in said downward direction.

3. The apparatus of claim 2 wherein:

said first bar folder means is located upstream from said second bar folder means for folding one of said outer panels before the folding of the other of said panels by said second bar folder means.

4. The apparatus of claim 3 further including:

a third bar folder means downstream from said first bar folder means; and selector means for selectively operating one of said first and third bar folder means, to cause said first bar folder means to fold one of said outer panels before the folding of the other of said panels by said second bar folder means, and to cause said third bar folder means to fold one of said outer panels after the folding of the other of said panels by said second bar folder means.

5. The apparatus of claim 4 wherein said selector means comprises:

lever means operatively connected to said first and third bar folder means for selectively connecting both of said first and said third bar folder means to a drive means for pivoting and reciprocating the selected one of said first and third bar folder means, said first bar folder means, when selectively connected for operation, being operative to fold one of said panels before the other of said panels is folded by said second bar folder means, and said third bar folder means, when selectively connected for operation, being operative to fold one of said panels after the other of said panels is folded by said second bar folder means.

6. The apparatus of claim 5 wherein said folding apparatus includes:

first and second laterally spaced lower rail means for supporting said first and second conveyor means respectively;

a drive shaft means extending laterally between said lower rail means;

a first gear means connecting said drive shaft means to said first bar folder means;

a second gear means connecting said drive shaft means to said second bar folder means; and a third gear means connecting said drive shaft means to said third bar folder means, said lever means adapted to engage a first clutch means in said first gear means for selectively connecting said first bar folder means for operation by said drive shaft means, and said lever means adapted to engage a second clutch means in said third gear means for selectively connecting said third bar folder means for operation by said drive shaft means when said lever means is selectively positioned to disconnect said first bar folder means from operation by said drive shaft means.

7. The apparatus of claim 6 wherein said first gear means includes:

a first rotary crank means connected between said first gear means and said first bar folder means for pivoting said first bar folder means from said substantially upright position to said substantially horizontal position and back to said substantially upright position during each rotation of said first crank means and for reciprocating said first bar folder means from an upstream position to a downstream position and back to said upstream position during each rotation of said first crank means, downstream movement of said first bar folder means beginning after downward pivoting of said first bar folder means begins; and a second rotary crank means connected between said third gear means and said third bar folder means for pivoting said third bar folder means from said substantially upright position to said substantially horizontal position and back to said substantially upright position during each rotation of said second crank means and for reciprocating said third bar folder means from an upstream position to a downstream position and back to said upstream position during each rotation of said second crank means, downstream movement of said third bar folder means beginning after downward pivoting of said third bar folder means begins, said second crank means being inoperative during operation of said first crank means and said first crank means being inoperative during operation of said second crank means.

8. The apparatus of claim 7 further including:

a blank holddown means located downstream from said second bar folder means for holding said other of said outer panels in said horizontal position, after said other panel has been folded by said second bar folding means, during advancement of said blank along said conveyor means.

9. The apparatus of claim 8 wherein said first and second folding means comprise:

first and second flexible rod means; and a plurality of adjustable support means mounting said rod means to said lower rail means.

10. Box blank folding apparatus comprising in combination:

first and second laterally spaced endless conveyor means for advancing box blanks through said apparatus;

first and second laterally spaced lower rail means for supporting said first and second conveyor means respectively;

first and second upper rail means spaced above each of said conveyor means respectively and defining edges against which outer panels of said blanks may be folded to a substantially upright position;

first and second flexible rod means underlying said outer panels near an upstream end of said conveyor means respectively and extending to a position above a top surface of said conveyor means for folding said outer panels from a horizontal position to said upright position as said blanks advance along said conveyor means;

a first bar folder means downstream from said first rod means and pivotable from an upright position adjacent a first of said outer panels to a horizontal position for folding said first panel over a first inner panel of said box blank;

a second bar folder means downstream from said second rod means and pivotable from an upright position adjacent a second of said outer panels to a horizontal position for folding said second panel over a second inner panel of said box blank after folding of said first outer panel;

a third bar folder means downstream from said first bar folder means and pivotable from an upright position adjacent said first outer panel to a horizontal position for folding said first panel over said first inner panel after folding of said second outer panel;

drive shaft means extending laterally between said lower rail means;

first, second, and third gear means connecting said drive shaft means to said first, second, and third bar folder means respectively, said gear means being operative to pivot said first, second, and third bar folder means and to longitudinally reciprocate each of said bar folder means in the direction of travel of said blanks so that said bar folder means moves with said blanks during at least a portion of said longitudinal reciprocation; and selector means for selectively operating said first and third gear means and consequently said first and third bar folder means connected thereto to cause said first outer panel to be folded ahead of or after folding of said second outer panel.

* * * * *